US005582658A

United States Patent [19]

Masui et al.

[11] Patent Number: 5,582,658

[45] Date of Patent: Dec. 10, 1996

[54] HIGH STRENGTH STEEL SHEET ADAPTED FOR PRESS FORMING AND METHOD OF PRODUCING THE SAME

[75] Inventors: Susumu Masui; Kei Sakata; Fusao Togashi; Masahiko Morita; Toshiyuki Kato, all of Chiba, Japan

[73] Assignee: Kawasaki Steel Corporation, Chiba, Japan

[21] Appl. No.: 571,683

[22] Filed: Dec. 13, 1995

Related U.S. Application Data

[63] Continuation of Ser. No. 407,803, Mar. 20, 1995, abandoned, which is a continuation of Ser. No. 110,490, Aug. 23, 1993, abandoned, which is a continuation of Ser. No. 745,433, Aug. 15, 1991, abandoned.

[30] Foreign Application Priority Data

Aug. 17, 1990 [JP] Japan ..... 2-215805
Mar. 13, 1991 [JP] Japan ..... 3-072194

[51] Int. Cl.[6] ..... C22C 38/02

[52] U.S. Cl. ..... 148/518; 148/603; 148/331; 148/333; 148/334

[58] Field of Search ..... 148/518, 603, 148/331, 333, 334

[56] References Cited

U.S. PATENT DOCUMENTS 2,737,455 3/1956 Kirkby et al. ..... 75/126
3,765,874 10/1973 Elias et al. ..... 148/2
4,441,936 4/1984 Takahashi et al. ..... 148/603

FOREIGN PATENT DOCUMENTS 0015154 9/1980 European Pat. Off. .
411515 2/1991 European Pat. Off. .
2156164 6/1972 Germany .
56-51532 5/1981 Japan .
62-20821 1/1987 Japan .
424904 4/1974 U.S.S.R. .
720614 12/1954 United Kingdom .

OTHER PUBLICATIONS

Metals Handbook, 1948 Edition, The American Society for Metals, 1948, p. 13.

*Primary Examiner*—Sikyin Ip
*Attorney, Agent, or Firm*—Dvorak and Traub

[57] ABSTRACT

A high strength steel sheet adapted for press forming and method producing the same. The steel sheet containing by weight C: 0.01–0.1%, Si: 0.1–1.2%, Mn: not more than 3.0%, Ti:a value of (Ti%–1.5S%–3.43N%)/C% being 4–12, B: 0.0005–0.005%, Al: not more than 0.1%, P: not more than 0.1%, S: not more than 0.02%, N: not more than 0.05%. The method for producing the steel sheet wherein a steel slab containing the above mentioned component composition is heated and hot rolled in a temperature range of 1100–1280° C. to provide a hot rolled sheet. The hot rolled sheet may be is subjected to cold rolling and annealing to provide a cold rolled sheet.

15 Claims, 3 Drawing Sheets

| Symbol | C content (wt %) |
|---|---|
| ● | 0.008 |
| ○ | 0.011 |
| ■ | 0.025 |
| □ | 0.032 |

0 wt % Si 1 wt % Si 1.5 wt % Si 2 wt % Si

HIGH STRENGTH STEEL SHEET ADAPTED FOR PRESS FORMING AND METHOD OF PRODUCING THE SAME

CROSS REFERENCE TO RELATED APPLICATIONS

This application is a continuation of application Ser. No. 08/407,803, filed Mar. 20, 1995, now abandoned, which is a continuation of application Ser. No. 08,110,490, filed Aug. 23, 1983, now abandoned, which is a continuation application of application 07/145,433, filed Aug. 15, 1991, now abandoned, entitled "HIGH STRENGTH SHEET ADAPTED FOR PRESS FORMING AND METHOD OF PRODUCING THE SAME."

BACKGROUND OF THE INVENTION

1. Field of the Invention

The present invention relates to a high strength steel sheet having a tensile strength not less than 40 kgf/mm$^2$ and a high press formability which is suitable for the use as an interior and exterior sheets for automobiles and a method of producing the same.

2. Description of Related Art

High strength steel sheets have been hitherto used for body constructing members, outer panels and the like of automobiles in order to reduce weight of an automobile body. Such high strength steel sheets for automobiles are required to have necessary press formability and a sufficient strength for ensuring safety of automobiles at the same time. In addition, recently, under a situation that the regulation of total emission of exhaust gas is being considerably enforced, there is a pressing need to contemplate to provide a high strength steel sheet having a higher strength in future.

On the other hand, these steel sheets are sometimes subjected to heat treatment at not less than 900° C. in order to eliminate distortion caused by forming or to increase secondary forming brittleness resistance, or heated to a high temperature due to welding, brazing or the like, so that it is also desired to have a property being hardly softened under such heating at a high temperature.

Further, from a viewpoint of a rust preventing property which has been recently considered to be especially important, it is desired to be a steel sheet with which various platings can be easily carried out.

Characteristics required for a high strength steel sheet having a high formability which is suitable for automobiles can be listed as follows.

(1) a ductility is high, (2) an r-value is high, (3) an yield ratio is low, and (4) an in-plane anisotropy of a material quality is small.

With respect to them, for example, there are disclosed a cold rolled steel sheet adapted for press forming in a large dimension which is excellent in rigidity (high Young's modulus) and a production method thereof in Japanese Patent Application Laid Open No. 57-181361, and a method of producing a cold rolled steel sheet for deep drawing having a slow aging property and a small anisotropy in Japanese Patent Application Laid Open No. 58-25436, respectively. In both of them, an extra low carbon steel is used as a base material, Nb, Ti and the other are added in a trace amount, and further continuous annealing conditions are controlled. Furthermore, phosphorus is used as a strengthening element in order to provide high tensile force since it gives less deterioration of material quality and has a large ability for strengthening solid solution. However, the limit of a tensile strength of this P-added extra low carbon steel is about a grade of 40 kgf/mm$^2$ at most, and it is clear that a component system using the extra low carbon steel added with the solid solution strengthening element will become difficult in adaptation thereof for requirements of high strength of steel sheets on account of improvement of automobile body weight to be light which is considered to proceed rapidly in future.

In addition, with respect to the in-plane anisotropy which is considered to be subjected to stronger requirements in future, there is a description in the above mentioned Japanese Patent Application Laid Open No. 58-25436, however, they have a low tensile strength such as 30 kgf/mm$^2$.

Other than the P-added solid solution strengthened steel sheet using the extra low carbon steel base as described above, as high tensile force steel sheets having different strengthening mechanisms are a transformation structure strengthened steel sheet (dual phase strengthened steel sheet), and a precipitation strengthened steel sheet.

Among them, the transformation structure steel sheet is easy to obtain a low yield ratio and excellent elongation, but it is not suitable for deep drawing because of a low r-value.

On the other hand, the precipitation strengthened steel sheet, namely a so-called HSLA (High Strength Low Alloy) steel sheet, is a steel in which Si, Mn, Nb and the like are added wherein solid solution strengthening of Si and Mn and strengthening owing to precipitation of a carbon nitride of Nb and strengthening owing to grain refining caused thereby are utilized, which is used for home electric appliances as well as for automobiles, however, a fault of this steel sheet is a high yield value, so that using conditions are restricted.

This precipitation strengthened steel sheet will be described hereinafter with following prior literatures.

There are disclosed a method of producing a high strength cold rolled steel sheet of the precipitation strengthened type in Japanese Patent Publication No. 54-27822 and a method for producing a high strength cold rolled steel sheet for deep drawing in Japanese Patent Publication No. 55-16214. However, in any one of them, the yield ratio exceeds 70%, and a high value not less than 80% is presented in almost all cases.

Further, Japanese Patent Application Laid Open No. 55-152128 also discloses a method of producing a precipitation strengthened steel sheet, wherein a high strength cold rolled steel sheet having a low yield ratio and excellent formability is produced by means of continuous annealing, but not refer to deep drawability of the steel sheet at all.

Furthermore, as to low C level Ti-IF (Interstitial Free) steels, Japanese Patent Application Laid Open No. 57-35662 discloses a cold rolled steel sheet for ultra-deep drawing which is excellent in secondary formability and Japanese Patent Application Laid Open No. 60-92453 discloses a cold rolled steel sheet for brazing and welding which is excellent in deep drawability. However, the tensile strength of the cold rolled steel sheet is less than 40 kgf/mm$^2$ in Japanese Patent Laid-Open No. 57-35662 according to an example thereof, which does not reach the target tensile strength level of 40 kgf/mm$^2$ in the present invention. In addition, Si is an essential component in the present invention and a limitation range thereof is 0.1–1.2 wt %, whereas there is no definition of Si in claims of Japanese Patent Application Laid Open No. 60-92453, and an Si content is not more than 0.09 wt % also in examples, so that it is essentially different from the present invention in which an effect of Si is effectively utilized.

SUMMARY OF THE INVENTION

An object of the present invention is to provide a high strength steel sheet and a method of producing the same wherein a low carbon steel which has a C content higher than that of the conventional extra low carbon steel is used as a base material, the IF formation is performed by adding Ti, and components to be added are adjusted closely, thereby a tensile strength is made not less than 40 kgf/mm$^2$ having a low yield ratio (less than 70%) lower than those of the conventional precipitation strengthened steels, an in-plane anisotropy is made small and further a softening formation resulting from abnormal grain growth under a reheating treatment is hardly performed.

The present invention is based on elucidation of the fact that a low C-high Ti component system in which Si is added is adopted to perform complete IF formation, thereby a high strength steel sheet having a low yield ratio and a small in-plane anisotropy can be obtained as a result of repeated various experiments and investigations.

According to the present invention, a high strength steel sheet adapted for press forming comprising a composition containing C: from 0.01 wt % to less than 0.1 wt %, Si: from 0.1 wt % to 1.2 wt %, Mn: not more than 3.0 wt %, Ti: a ratio of effective *Ti (wt %) represented by the following equation, to said C (wt %), that is the effective *Ti (wt %)/C (wt %) is from 4 to 12:

effective *Ti (wt %)=Ti (wt %)−1.5S (wt %)−3.43N (wt %),

B: from 0.0005 wt % to 0.005 wt %,

Al: not more than 0.1 wt %,

P: not more than 0.1 wt %,

S: not more than 0.02 wt %,

N: not more than 0.005 wt %, and the remainder being iron and inevitable impurities.

The high strength steel sheet according to the present invention further containing one or more kinds selected from V: from 0.02 wt % to 0.2 wt %, Nb: from 0.02 wt % to 0.2 wt %, and Zr: from 0.02 wt % to 0.2 wt % by replacing a part of iron of the remainder.

The high strength steel sheet according to another aspect of the present invention further containing one or more kinds of ones selected from Cr: from 0.05 wt % to 1.5 wt %, Ni: from 0.05 wt % to 2.0 wt %, Mo: from 0.05 wt % to 1.0 wt %, and Cu: from 0.05 wt % to 1.5 wt %, by replacing a part of iron of the remainder.

The high strength steel sheet according to another aspect of the present invention further containing Ca: from 0.0005 wt % to 0.005 wt %, by replacing a part of iron of the remainder.

According to another aspect of the present invention, a method of producing a high strength steel sheet adapted for press forming, comprises steps of preparing a steel slab containing C: from 0.01 wt % to less than 0.1 wt %, Si: from 0.1 wt % to 1.2 wt %, Mn: not more than 3.0 wt %, Ti: a ratio of effective *Ti (wt %) represented by the following equation to said C (wt %), that is the effective *Ti (wt %)/C (wt %) is from 4 to 12:

effective *Ti (wt %)=Ti (wt %)-1.5S (wt %)-3.43N (wt %),

B: from 0.0005 wt % to 0.005 wt %,

Al: not more than 0.1 wt %,

P: not more than 0.1 wt %,

S: not more than 0.02 wt %, and

N: not more than 0.005 wt %, heating the steel slab at 1100° C.~1280° C., and hot rolling to provide a hot rolled sheet.

In the method of producing a high strength steel sheet adapted for press forming, the hot rolling step may be followed by a step of electroplating or hot dipping.

According to another aspect of the present invention, a method of producing a high strength steel sheet adapted of press forming comprises steps of preparing a steel slab containing C: from 0.01 wt % to less than 0.1 wt %, Si: from 0.1 wt % to 1.2 wt %, Mn: not more than 3.0 wt %, Ti: a ratio of effective *Ti (wt %) represented by the following equation to said C (wt %), that is the effective *Ti (wt %)/C (wt %) is from 4 to 12:

effective *Ti (wt %)=Ti (wt %)=1.5S (wt %)-3.43N (wt %),

B: from 0.0005 wt % to 0.005 wt %,

Al: not more than 0.1 wt %,

P: not more than 0.1 wt %,

S: not more than 0.02 wt %, and

N: not more than 0.005 wt %, heating the steel slab at 1100° C.~1280° C., hot rolling the heated steel slab to make a hot rolled steel sheet, subsequently cold rolling the steel sheet, and then annealing the cold rolled sheet at a temperature not lower than a recrystallization temperature.

In the method of producing a high strength steel sheet, the annealing step may be followed by a step of electroplating or hot dipping.

BRIEF DESCRIPTION OF THE DRAWINGS

For a better understanding of the invention reference is taken to the accompanying drawings, in which.

DESCRIPTION OF THE PREFERRED EMBODIMENTS

At first, experimental results which are the basis of the present invention will be described.

Twelve kinds of cold rolled steel sheets having a sheet thickness of 0.70 mm, in which a chemical component composition was C: 0.05 wt %, Mn: 0.5 wt %, Ti: 0.2 wt %, B: 0.0005 wt %, AI: 0.05 wt %, P: 0.01 wt %, S: 0.001 wt %, and N: 0.0015 wt % and further an Si content was varied within a range of 0–2.60 wt % to be contained, were prepared and heat treated at 700° C. in an annealing box.

The steel sheets as annealed were subjected to a test for tensile properties.

Figure 1:
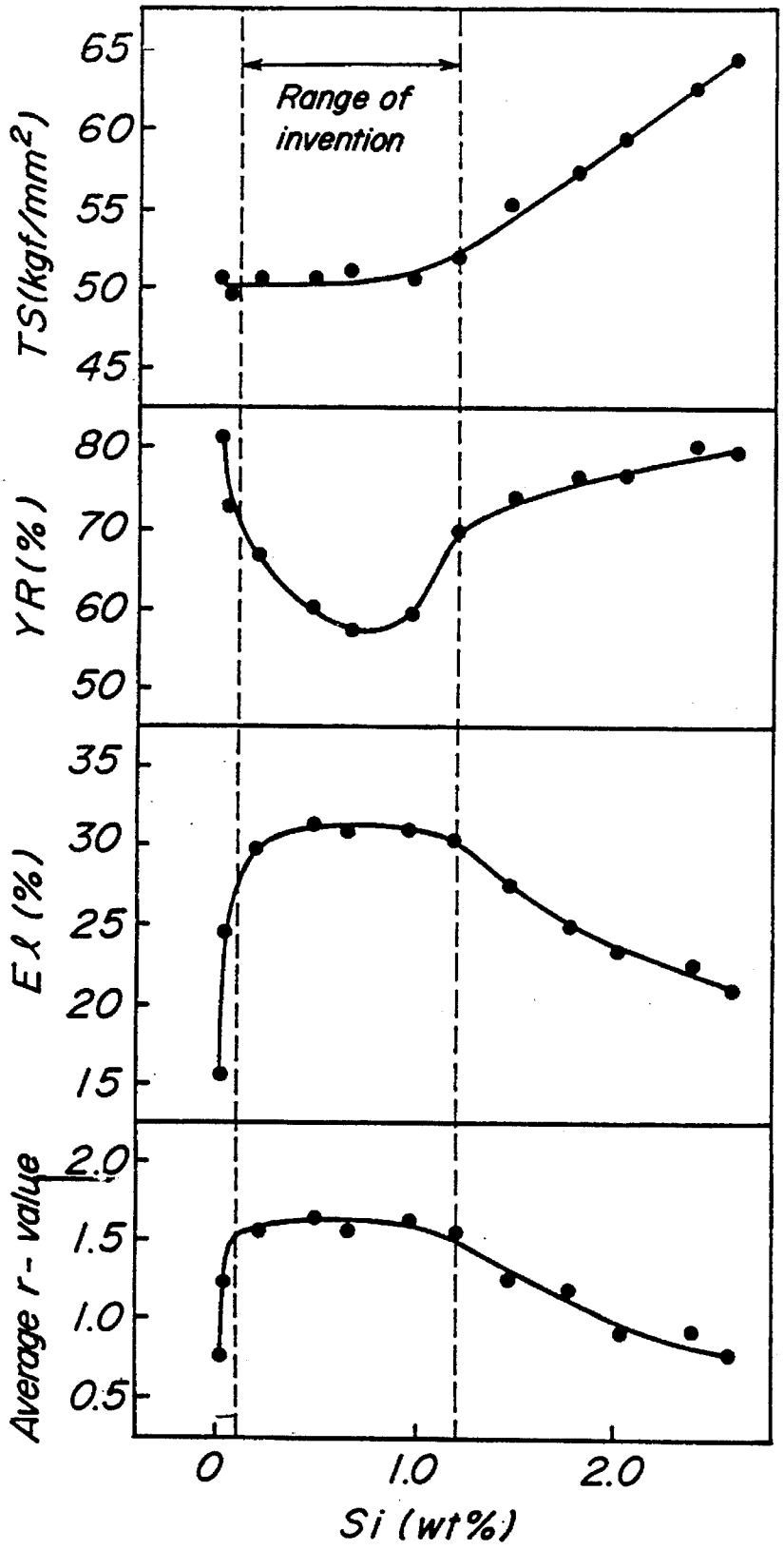
FIG. 1 shows relationships between the tensile properties and the Si content.

Results of the above test for various relationships between tensile properties and Si content are shown in FIG. 1.

It will be seen from FIG. 1, within a range of 0.1–1.2 wt % of the Si content were attained low yield ratio, high elongation and high average r-values. These effects of Si owe to a ferrite purifying function by Si.

Next, with respect to steel sheets which have press formability and are difficult to suffer softening nature formation at a high temperature, relationship between C and Ti was investigated by the following experiments.

Using 32 kinds of steel materials in which a chemical component composition was Si: 0.5 wt %, Mn: 0.3 wt %, B: 0.0012 wt %, Al: 0.04 wt %, P: 0.05 wt %, and S: 0.010 wt % and contents of C and Ti were variously varied to be contained, heating to 1200° C. was performed, and then hot rolling was performed at a finish rolling temperature of 900° C., and winding was performed at a temperature of 550° C. to provide hot rolled sheets having a thickness of 3.00 mm. In addition, a part of the hot rolled sheets were subjected to a scale removing treatment followed by cold rolling with a reduction ratio of 75%, which were continuously annealed under a condition of maintaining at 800° C. for 40 seconds and cooling at 20° C./second (without excess aging), and then subjected to a temper rolling with an elongation ratio of 0.8% to provide cold rolled sheets having a thickness of 0.75 mm.

The hot rolled sheets and the cold rolled sheets thus obtained were subjected to a heat treatment at 1000° C. for one hour followed by cooling at 5° C./second, and then subjected to a measurement for grain size. Results of the measurement are summarized to show in FIGS. 2*a* and 2*b*.

Figure 2A:
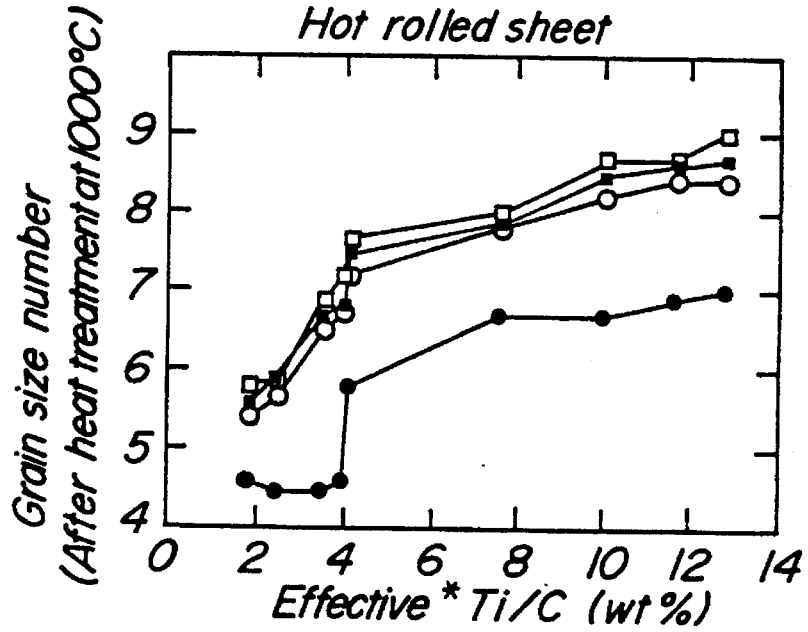
FIG. 2*a* is a graph showing relationships between the C amount and *Ti/C (weight ratio) which have an inference on the grain size of the hot rolled sheet after reheating at 1000° C.
Figure 2B:
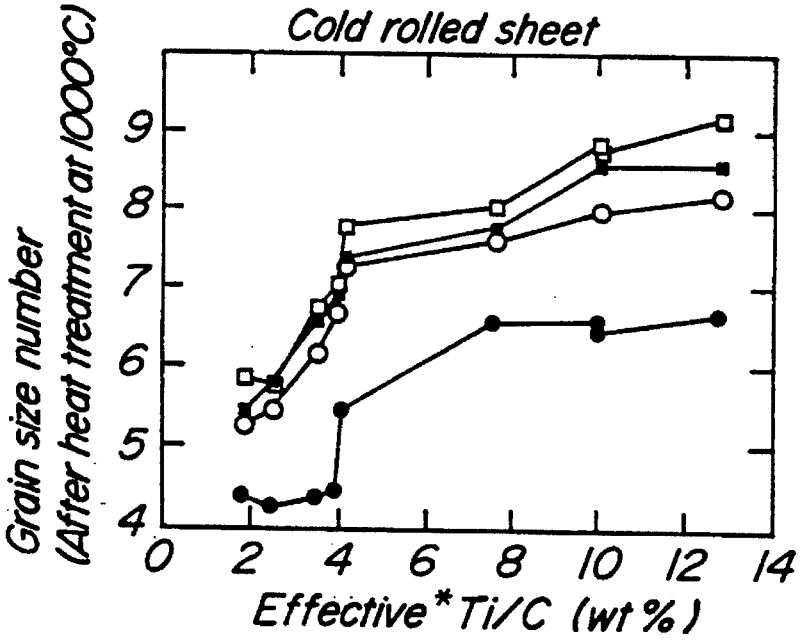
FIG. 2*b* is a graph showing relationships between the C amount and *Ti/C (weight ratio) which have an inference on the grain size of the cold rolled sheet after reheating at 1000° C.

FIGS. 2*a* and 2*b* show relationships between C wt % and the effective *Ti wt %/C wt % (effective *Ti wt %=Ti wt %-1.5S wt %-3.43N wt %) which have influence on the grain size. It will be understood from the figures, the grain size number becomes large when the effective *Ti wt %/C wt % is not less than 4 for both the hot rolled sheets and the cold rolled sheets, so that an effective *Ti content not less than 4 is sufficient for fixing C.

As described above, even after performing the heat treatment at 1000° C., no coarse formation of grains is observed when C content is not less than 0.01 wt % and the effective *Ti wt %/C wt % is not less than 4, and the grain size number indicates not less than 7.

It should be noted that with respect to the grain size after the heating, no softening takes place provided that the grain size number is not less than 7.

According to the above mentioned results, in order to prevent abnormal grain growth during the reheating (prevention of the softening), the C content should be not less than 0.01 wt % and the effective *Ti wt %/C wt % should be not less than 4, it is postulated as a reason thereof that generated fine carbides of the Ti system exist relatively stably even during the reheating, so that they are effective for restricting the abnormal grain growth.

Further, as a result of detailed experiments, it has been found that the Si content have a great influence on the in-plane anisotropy and the r-value.

Figure 3A:
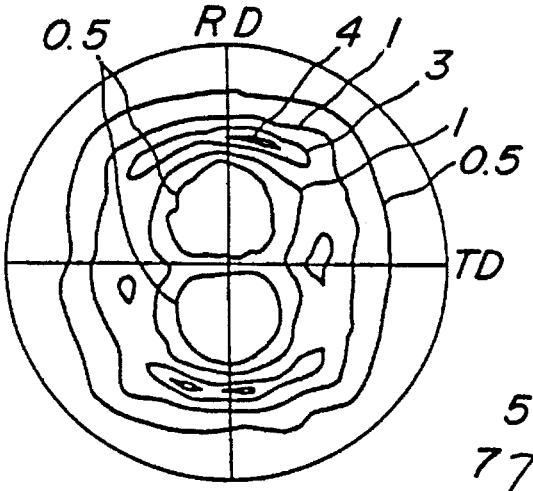
FIG. 3*a* is a (200) pole figure of a steel sheet having no Si content.
Figure 3B:
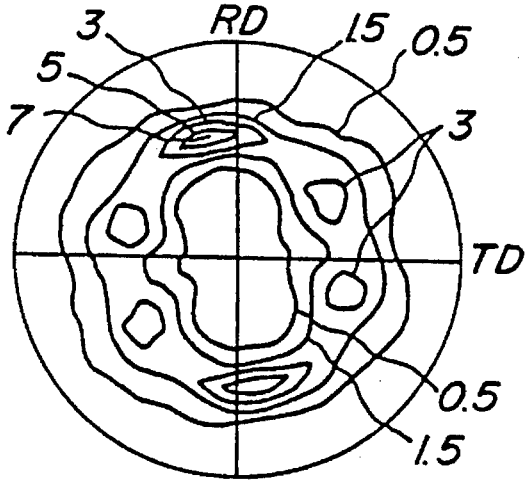
FIG. 3*b* is a (200) pole figure of a steel sheet having the Si content of 1 wt %.
Figure 3C:
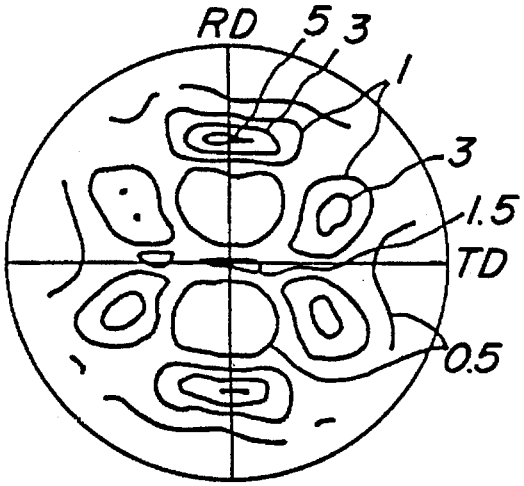
FIG. 3*c* is a (200) pole figure of a steel sheet having the Si content of 1.5 wt %.
Figure 3D:
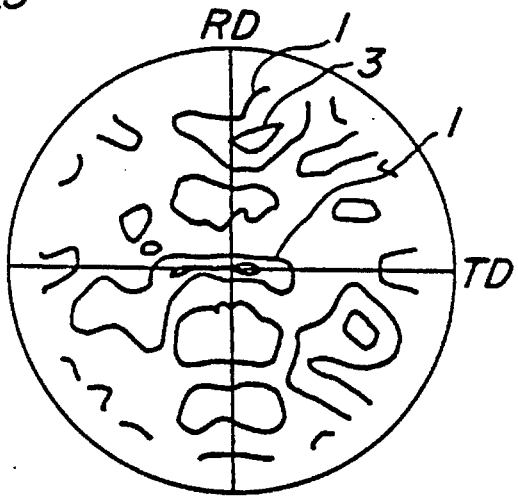
FIG. 3*d* is a (200) pole figure of a steel sheet having the Si content of 2.0 wt %.

FIGS. 3*a*, 3*b*, 3*c*, and 3*d* show pole figures measured on four kinds of cold rolled sheets containing C: 0.05 wt %, Si: 0 wt %, 1.0 wt %, 1.5 wt %, and 2.0 wt %, respectively, Mn: 0.01 wt %, Ti: 0.206 wt %, B: 0.0008 wt %, Al: 0.04 wt %, P: 0.01 wt %, S: 0.001 wt %, and N: 0.0014 wt %, which steel sheets were subjected to box annealing at 720° C., FIGS. 3*a*, *b*, *c*, and *d* correspond to the Si content of 0 wt %, 1.0 wt %, 1.5 wt %, and 2.0 wt %, respectively. It will be seen from the pole figures, that FIG. 3*b* in which the Si content is 1.0 wt % shows a strong {111}<112> texture and a weak development in a <100>||ND orientation. This is indeed such one in which the in-plane anisotropy is small and the r-value is enhanced. Accordingly, the Si content is preferably about 1 wt %.

The reason for limitation of chemical component composition ranges of the steel of the present invention will be described. [C]: If the C content is less than 0.01 wt %, the target tensile strength of not less than 40 kgf/mm$^2$ cannot be obtained, and the softening is apt to take place at a high temperature. On the other hand, if not less than 0.1 wt % is contained, in the case of production by means of the continuous annealing method, the grain growth property during the annealing is rapidly reduced, and no desired ductility can be obtained. Therefore, its content is limited from 0.01 wt % to less than 0.1 wt %. [Si]: Si is an important component in the invention and has an effect for discharging C from the ferrite and facilitating precipitation and coagulation to be coarse of titanium carbide, and if the content is less than 0.1 wt %, the effect does not appear. On the other hand, if it exceeds 1.2 wt % to be contained, the ductility is rapidly deteriorated due to the ability of enhancing the solid solution of Si itself, and the r-value and further various plating properties are deteriorated. Therefore, the Si content is limited from 0.1 wt % to 1.2 wt %, however, from a viewpoint of increasing the in-plane anisotropy and the r-value, it is preferable to be from 0.4 wt % to 1.0 wt %.

[Mn]: Mn is useful as a heightening component of the steel. However, if it exceeds 3.0 wt % to be contained, there is given excess hardening, resulting in considerable deterioration of the ductility. Therefore, the upper limit of Mn content should be 3.0 wt %.

[Ti]: Ti is an important component in the invention, which is necessary for fixing C, S, and N. If the effective *Ti is less than 4C, C cannot be fixed completely, and the grain become coarse to provide the softening as a result of reheating as described above. On the other hand, if the effective *Ti exceeds 12C to be contained, there is given excess solid solution of Ti to deteriorate the material quality, and further a surface quality of the steel sheet is also damaged. Therefore, its content should be in a range which satisfies a range in which *Ti/C is from 4 to 12 (effective *Ti=Ti–1.5S–3.43N).

[B]: B is necessary for improving the secondary forming brittleness, and if the content is less than 0.0005 wt %, its effect is insufficient, whereas if it exceeds 0.005 wt %, deterioration of the deep drawability becomes considerable. Therefore, its content is limited from 0.0005 wt % to 0.005 wt %.

[A1]: A1 is a component which is useful for fixing 0 in the steel and preventing decrease in the effective *Ti content by bonding to 0, however, even if it exceeds 0.1 wt % to be contained, its effect is saturated. Therefore, the upper limit of Al content should be 0.1 wt %.

[P]: P is an extremely excellent solid solution heightening component, however, if it exceeds 0.1 wt % to be contained, a surface quality of the steel is considerably deteriorated. Therefore, the upper limit of P content should be 0.1 wt %. Incidentally, taking a relation to the C content into account, it is preferable that P(wt %)/C(wt %) is less than 1.5.

[S]: S may become a cause of crack generation during hot rolling, therefore the upper limit of S content should be 0.002 wt %.

[N]: A large containing amount of N reduces the effective *Ti amount, and induces deterioration of the r-value and the ductility. Therefore, the lower content of N is the more preferable, and the upper limit of N content should be 0.005 wt %.

[V, Nb, Zr, Cr, Ni, Mo, and Cu]:

In addition, in the present invention, in addition to the above mentioned chemical component composition, in order to ensure the strength, one or more kinds of ones among V, Nb, and Zr which are components for forming carbide can be contained. The effect thereof is expressed at a content not less than 0.02 wt % respectively, however, if they exceed 0.2 wt %, deterioration of the ductility is caused. Therefore, the content of V, Nb, and Zr is limited from 0.02 wt % to 0.2 wt %, respectively. Under the same purpose, one or more kinds of ones among Cr, Ni, Mo, and Cu which are components for strengthening solid solution can be contained. The effect thereof is expressed at a content not less than 0.05 wt % respectively, however, if they are excessively contained, deterioration of surface quality of the steel is caused. Therefore, the Cr content is limited from 0.05 wt % to 1.5 wt %, the Ni content is limited from 0.05 wt % to 2.0 wt %, the Mo content is limited from 0.05 wt % to 1.0 wt %, and the Cu content is limited from 0.05 wt % to 1.5 wt %.

[Ca]: Further, in order to control configurations of inclusions, Ca can be added. Its effect is expressed when the Ca content is not less than 0.0005 wt %, however, if it exceeds 0.005 wt %, its effect is saturated as well as deterioration of material quality becomes considerable. Therefore, the Ca content is limited from 0.0005 wt % to 0.005 wt %.

The reason why a low yield ratio can be obtained in the invention in spite of fact that the low carbon steel which has a C content higher than the extra low carbon steel is used to provide the high strength, will be described hereinafter.

Namely, as the reason thereof, the effective *Ti/C is made not less than 4, thereby C, S, and N are completely fixed and the IF formation is completely achieved. It is considered that this reduces the fixing function and effect of dislocation, and movable dislocation is increased, thereby the low yield ratio is obtained.

Next, production step conditions according to the invention will be described.

At first, a steel-making method may be carried out in accordance with conventional methods, and especially no limitation for their conditions is required.

If a slab heating temperature is less than 1100° C., the workability of the product is deteriorated, and if it exceeds 1280° C., coarse grains appear resulting in nonuniformity of material quality thereafter. Therefore, the slab heating temperature should be in a temperature range 1100° C.–1280° C. Moreover, from a viewpoint of energy saving, a continuous casting slab may be subsequently subjected to a rough hot rolling immediately or after a temperature holding treatment at a temperature range of 1100° C.–1280° C., without cooling to a temperature lower than 1100° C. after reheating or continuous casting.

With respect to a hot rolling finish temperature, if the temperature is too high, the final structure becomes coarse which is disadvantageous for the ductility. On the other hand, if it is too low, expansion of the structure becomes considerable and a rolling load is rapidly increased, which is not preferable from a viewpoint of operation. Therefore, it is preferable that the hot rolling finish temperature is in a temperature range not less than the Ar3 transformation point and not more than the Ar3 transformation point +100° C.

With respect to a winding temperature after the hot rolling, it may be in a temperature range of 400° C.–700° C. taking account of a following pickling property and an ability of a winding machine.

In cold rolling, in order to obtain sufficient formability after the annealing, it is preferable that the cold rolling reduction ratio is not less than 55%.

The annealing after the cold rolling should be performed at a temperature lower than a recrystallization temperature in order to perform recrystallization. However, in order to prevent composite texture formation after the annealing, a temperature lower than the Ac3 transformation point is preferable. With respect to the annealing method, there is no special limitation, and either a continuous annealing method or a box annealing method may be available.

With respect to plating conditions, in the case of the electroplating, both of the hot rolled sheet and the cold rolled sheet may be subjected to plating with a predetermined plating amount by means of an ordinary method, and in the case of the hot dipping, in addition to a line of the hot dipping alone, in the annealing step, application to a continuous hot dipping line may be available.

Further, these steel sheets may be subjected to the temper rolling with a purpose of correction of a sheet configuration in a degree of a reduction ratio (%) equal to a sheet thickness (mm) in a range of normal common sense.

Furthermore, the steel sheet according to the present invention may be subjected to special treatments after the annealing or the plating so as to perform improvement of chemical treatment properties, welding properties, press formability, corrosion resistance and the like.

EXAMPLE

Continuous cast slabs of 26 steel types of suitable steels of the present invention and 5 steel types of comparative steels (total 31 steel types) having chemical component compositions shown in Table 1 and Table 2 produced by melting in a converter were subjected to hot rolling respectively to finish to have a sheet thickness of 3.2 mm for steel symbols O, P, Q, and R and that of 2.8 mm for all other steel types. In addition, a part of them were subjected to zinc hot dipping.

TABLE 1

| Steel symbol | C | Si | Mn | Ti | B | Al | P | S | N | (wt %) V |
|---|---|---|---|---|---|---|---|---|---|---|
| A | 0.026 | 1.1 | 0.20 | 0.17 | 0.0012 | 0.023 | 0.035 | 0.008 | 0.004 | |
| B | 0.041 | 0.6 | 0.15 | 0.25 | 0.0007 | 0.027 | 0.025 | 0.004 | 0.003 | |
| C | 0.022 | 0.9 | 0.10 | 0.15 | 0.0009 | 0.035 | 0.020 | 0.007 | 0.003 | |
| D | 0.032 | 0.7 | 0.15 | 0.20 | 0.0006 | 0.037 | 0.015 | 0.008 | 0.004 | |
| E | 0.036 | 1.0 | 0.15 | 0.22 | 0.0014 | 0.028 | 0.025 | 0.010 | 0.003 | 0.09 |
| F | 0.022 | 0.8 | 0.10 | 0.16 | 0.0009 | 0.038 | 0.025 | 0.007 | 0.003 | |
| G | 0.047 | 0.8 | 0.15 | 0.31 | 0.0005 | 0.027 | 0.025 | 0.009 | 0.003 | |
| H | 0.052 | 0.6 | 0.20 | 0.34 | 0.0008 | 0.031 | 0.010 | 0.005 | 0.002 | |
| I | 0.025 | 0.6 | 0.50 | 0.14 | 0.0009 | 0.046 | 0.050 | 0.002 | 0.002 | |
| J | 0.044 | 0.5 | 0.25 | 0.23 | 0.0005 | 0.032 | 0.080 | 0.005 | 0.003 | |
| K | 0.034 | 0.8 | 0.35 | 0.19 | 0.0010 | 0.034 | 0.025 | 0.006 | 0.002 | 0.04 |
| L | 0.021 | 0.7 | 0.15 | 0.15 | 0.0013 | 0.039 | 0.015 | 0.010 | 0.003 | |
| M | 0.015 | 0.9 | 0.60 | 0.12 | 0.0008 | 0.041 | 0.020 | 0.009 | 0.002 | |
| N | 0.030 | 0.7 | 0.45 | 0.19 | 0.0011 | 0.024 | 0.010 | 0.005 | 0.003 | 0.12 |
| O | 0.025 | 0.6 | 0.37 | 0.13 | 0.0012 | 0.051 | 0.049 | 0.011 | 0.0025 | |
| P | 0.010 | 0.34 | 0.88 | 0.09 | 0.0023 | 0.047 | 0.059 | 0.009 | 0.0021 | |
| Q | 0.017 | 0.1 | 0.76 | 0.16 | 0.0015 | 0.034 | 0.088 | 0.004 | 0.0018 | |

| Steel symbol | Nb | Zr | Cr | Ni | Mo | Cu | Ca | Effective*Ti/C (weight ratio) | (wt %) Remark |
|---|---|---|---|---|---|---|---|---|---|
| A | | | | | | | | 5.52 | Suitable |
| B | | | | | | | | 5.68 | example |
| C | | | | | | | | 5.84 | |
| D | 0.07 | | | | | | | 5.44 | |
| E | | 0.06 | | | | | | 5.40 | |
| F | | | | | 0.8 | | | 5.84 | |
| G | | | | | | 0.3 | | 6.08 | |
| H | | | 0.6 | 1.1 | | | | 6.24 | |
| I | | | | | | | 0.0010 | 5.20 | |
| J | 0.05 | | 1.2 | | | 0.9 | | 4.80 | |
| K | | | | 0.3 | 0.1 | | 0.0007 | 5.12 | |
| L | 0.11 | 0.04 | | | | 0.8 | | 5.92 | |
| M | | 0.13 | 0.4 | | 0.2 | | 0.0015 | 6.04 | |
| N | 0.03 | | | 0.4 | | 0.4 | 0.0009 | 5.04 | |
| O | | | | | | | | 4.20 | |
| P | | | | | | | | 6.93 | |
| Q | | | | | | | | 10.46 | |

TABLE 2

| Steel symbol | C | Si | Mn | Ti | B | Al | P | S | N | (wt %) V |
|---|---|---|---|---|---|---|---|---|---|---|
| R | 0.030 | 0.2 | 0.30 | 0.16 | 0.0017 | 0.029 | 0.050 | 0.010 | 0.0019 | |
| S | 0.077 | 0.4 | 0.56 | 0.38 | 0.0007 | 0.043 | 0.025 | 0.003 | 0.0035 | |
| T | 0.037 | 1.0 | 0.15 | 0.24 | 0.0011 | 0.037 | 0.015 | 0.002 | 0.0032 | 0.14 |
| U | 0.015 | 0.1 | 0.92 | 0.11 | 0.0016 | 0.048 | 0.010 | 0.002 | 0.0027 | |
| V | 0.042 | 0.6 | 0.57 | 0.23 | 0.0009 | 0.041 | 0.040 | 0.006 | 0.0024 | |
| W | 0.025 | 0.3 | 0.10 | 0.15 | 0.0020 | 0.035 | 0.035 | 0.012 | 0.0017 | 0.03 |
| X | 0.063 | 0.7 | 0.40 | 0.36 | 0.0014 | 0.051 | 0.030 | 0.008 | 0.0038 | |
| Y | 0.091 | 0.4 | 0.25 | 0.44 | 0.0005 | 0.045 | 0.020 | 0.004 | 0.0021 | 0.02 |
| Z | 0.012 | 0.5 | 0.35 | 0.10 | 0.0025 | 0.040 | 0.066 | 0.005 | 0.0042 | |
| a | 0.003* | 0.6 | 0.25 | 0.01 | 0.0005 | 0.032 | 0.080 | 0.005 | 0.003 | |
| b | 0.100* | 0.9 | 0.20 | 0.46 | 0.0010 | 0.034 | 0.025 | 0.006 | 0.002 | |
| c | 0.045 | 0.7 | 0.15 | 0.15 | 0.0013 | 0.039 | 0.015 | 0.010 | 0.003 | |
| d | 0.026 | 1.1 | 0.25 | 0.50 | 0.0008 | 0.041 | 0.020 | 0.009 | 0.002 | |
| e | 0.031 | 2.1* | 0.10 | 0.18 | 0.0011 | 0.024 | 0.010 | 0.005 | 0.003 | |

| Steel symbol | Nb | Zr | Cr | Ni | Mo | Cu | Ca | Effective*Ti/C (weight ratio) | (wt %) Remark |
|---|---|---|---|---|---|---|---|---|---|
| R | | | | | | | | 4.62 | Suitable |
| S | | 0.16 | | | | | | 4.72 | example |
| T | | | | | | | | 6.10 | |
| U | | | | 1.6 | | | | 6.51 | |
| V | | | 1.3 | | | | | 5.06 | |
| W | 0.03 | 0.14 | 0.2 | 0.1 | 0.07 | 0.1 | 0.0008 | 5.04 | |
| X | | 0.03 | 0.3 | 0.7 | 0.4 | | | 5.31 | |
| Y | 0.02 | | | | | 0.2 | 0.0025 | 4.69 | |
| Z | 0.16 | | | 0.6 | | 1.1 | | 6.50 | |
| a | | | | | | | | −2.56* | Compar- |

TABLE 2-continued

| | | |
|---|---|---|
| b | 4.44 | ative |
| c | 2.76* | example |
| d | 8.44* | |
| e | 5.20 | |

*indicates one existing without the limited range of the invention

With respect to steel sheets thus obtained, mechanical properties, the aging index AI, and the grain size number after the heat treatment (reheating) were investigated.

The above mentioned hot rolling conditions and results of the investigation were summarized to show in Table 3 and Table 4.

TABLE 3

(Hot rolled steel sheets)

| Sample No. | Steel symbol | Hot rolling conditions: Slab heating temperature (°C.) | Hot rolling conditions: Hot rolling finish temperature (°C.) | Hot rolling conditions: Winding temperature (°C.) | Mechanical properties: YS (kgf/mm²) | Mechanical properties: TS (kgf/mm²) | Mechanical properties: YR (%) | Mechanical properties: El (%) | Al (kgf/mm²) | Property after heat treatment: Grain size number | Plating | Remarks |
|---|---|---|---|---|---|---|---|---|---|---|---|---|
| 1 | A | 1250 | 895 | 690 | 29.1 | 46.1 | 63.1 | 34.9 | 0.0 | 8.0 | none | Suitable example |
| 2 | B | 1200 | 895 | 700 | 32.0 | 50.4 | 63.4 | 30.1 | 0.0 | 8.1 | zinc hot dipping | Suitable example |
| 3 | C | 1050* | 890 | 615 | 46.3 | 58.7 | 78.8 | 17.4 | 0.5 | 6.9 | none | Comparative example |
| 4 | D | 1180 | 890 | 500 | 30.4 | 47.9 | 63.4 | 33.6 | 0.1 | 7.9 | electro-plating | Suitable example |
| 5 | E | 1320* | 895 | 630 | 37.9 | 48.6 | 77.9 | 29.6 | 0.2 | 6.5 | none | Comparative example |
| 6 | F | 1150 | 885 | 570 | 26.1 | 42.9 | 60.8 | 37.4 | 0.0 | 7.7 | none | Suitable example |
| 7 | G | 1020* | 890 | 640 | 41.6 | 52.7 | 78.9 | 23.1 | 0.4 | 6.7 | zinc hot dipping | Comparative example |
| 8 | H | 1230 | 895 | 480 | 34.9 | 53.8 | 64.8 | 28.6 | 0.0 | 8.1 | aluminum hot dipping | Suitable example |
| 9 | I | 1170 | 900 | 550 | 27.7 | 45.5 | 60.8 | 36.1 | 0.0 | 7.8 | none | Suitable example |
| 10 | J | 1040* | 870 | 600 | 40.3 | 51.1 | 78.8 | 24.4 | 0.5 | 6.7 | none | Comparative example |
| 11 | K | 1190 | 885 | 660 | 30.5 | 48.5 | 62.8 | 32.9 | 0.0 | 8.2 | electro-plating | Suitable example |
| 12 | L | 1310* | 875 | 600 | 32.3 | 43.1 | 74.9 | 31.5 | 0.2 | 6.5 | none | Comparative example |
| 13 | M | 1200 | 890 | 580 | 24.7 | 41.8 | 59.0 | 39.2 | 0.0 | 7.8 | zinc hot dipping | Suitable example |
| 14 | N | 1180 | 880 | 620 | 29.4 | 47.4 | 62.0 | 34.2 | 0.0 | 7.5 | none | Suitable example |
| 15 | O | 1260 | 895 | 560 | 28.5 | 45.6 | 62.5 | 35.3 | 0.3 | 7.9 | none | Suitable example |
| 16 | P | 1240 | 895 | 560 | 25.2 | 44.0 | 57.2 | 38.0 | 0.0 | 7.8 | none | Suitable example |
| 17 | Q | 1200 | 895 | 560 | 26.2 | 45.1 | 58.0 | 37.4 | 0.0 | 8.0 | none | Suitable example |
| 18 | R | 1270 | 895 | 560 | 28.4 | 46.8 | 60.6 | 36.5 | 0.5 | 8.1 | none | Suitable example |
| 19 | S | 1190 | 885 | 610 | 38.2 | 59.7 | 63.9 | 25.5 | 0.1 | 8.3 | zinc hot dipping | Suitable example |
| 20 | T | 1230 | 900 | 550 | 30.1 | 49.9 | 60.3 | 30.9 | 0.0 | 7.9 | none | Suitable example |

*indicates one existing without the limited range of this invention

TABLE 4

(Hot rolled steel sheets)

| Sample No. | Steel symbol | Hot rolling conditions: Slab heating temperature (°C.) | Hot rolling conditions: Hot rolling finish temperature (°C.) | Hot rolling conditions: Winding temperature (°C.) | Mechanical properties: YS (kgf/mm²) | Mechanical properties: TS (kgf/mm²) | Mechanical properties: YR (%) | Mechanical properties: El (%) | Al (kgf/mm²) | Property after heat treatment: Grain size number | Plating | Remarks |
|---|---|---|---|---|---|---|---|---|---|---|---|---|
| 21 | U | 1280 | 890 | 640 | 28.1 | 46.6 | 61.3 | 34.1 | 0.0 | 7.7 | electro-plating | Suitable example |
| 22 | V | 1150 | 880 | 600 | 30.9 | 51.1 | 60.4 | 29.6 | 0.0 | 7.9 | none | Suitable example |
| 23 | W | 1250 | 895 | 580 | 29.5 | 47.6 | 61.9 | 33.9 | 0.1 | 7.8 | none | Suitable example |
| 24 | X | 1200 | 885 | 620 | 34.2 | 55.3 | 61.8 | 28.9 | 0.0 | 8.1 | zinc hot dipping | Suitable example |
| 25 | Y | 1250 | 890 | 600 | 40.7 | 62.7 | 64.9 | 23.9 | 0.1 | 8.4 | none | Suitable example |
| 26 | Z | 1200 | 900 | 580 | 27.2 | 44.8 | 60.7 | 37.9 | 0.0 | 7.6 | none | Suitable example |
| 27 | a | 1240 | 895 | 620 | 29.7 | 37.2 | 79.8 | 39.0 | 5.7 | 6.4 | zinc hot dipping | Comparative example |
| 28 | b | 1200 | 885 | 560 | 46.9 | 65.2 | 71.9 | 15.1 | 0.2 | 7.7 | none | Comparative example |
| 29 | c | 1140 | 880 | 640 | 41.6 | 51.4 | 80.9 | 23.9 | 4.6 | 6.6 | none | Comparative example |
| 30 | d | 1170 | 890 | 540 | 35.9 | 47.3 | 75.8 | 29.7 | 0.0 | 8.2 | none | Comparative example |
| 31 | e | 1210 | 900 | 660 | 41.1 | 49.1 | 83.7 | 27.3 | 0.1 | 7.2 | none | Comparative example |
| 32 | C | 1150 | 890 | 520 | 24.8 | 42.1 | 58.9 | 38.3 | 0.0 | 7.5 | electro-plating | Suitable example |
| 33 | E | 1260 | 885 | 680 | 30.9 | 48.9 | 63.1 | 32.5 | 0.1 | 7.7 | none | Suitable example |
| 34 | G | 1200 | 890 | 500 | 31.4 | 51.8 | 60.6 | 28.9 | 0.0 | 7.4 | none | Suitable example |
| 35 | J | 1280 | 900 | 700 | 25.1 | 42.3 | 59.3 | 37.9 | 0.1 | 7.9 | zinc hot dipping | Suitable example |
| 36 | L | 1120 | 890 | 480 | 24.2 | 41.4 | 58.4 | 40.3 | 0.0 | 7.8 | none | Suitable example |

Further, a part of the above mentioned hot rolled sheets (those having a slab heating temperature suitable for the present invention) were subjected to cold rolling with a reduction ratio of 75% after scale removing to give a sheet thickness of 0.8 mm or 0.70 mm followed by being subjected to continuous annealing or box annealing, and then subjected to temper rolling with a reduction ratio of 0.80% or 0.70%. In addition, a part of them were subjected to electroplating or hot dipping.

With respect to steel sheets thus obtained, mechanical properties including Δr which is an index of the average r-value and the in-plane anisotropy, the aging index AI, the crystal grain size number after heat treatment were investigated.

Annealing conditions and results of the above mentioned investigations are summarized to show in Table 5 and Table 6.

TABLE 5

(Cold rolled steel sheets)

| Sample No. | Steel symbol | Annealing condition | Recrystallization temperature (°C.) | Mechanical properties: YS (kgf/mm²) | Mechanical properties: TS (kgf/mm²) | Mechanical properties: YR (%) | Mechanical properties: El (%) | r-value | Δr |
|---|---|---|---|---|---|---|---|---|---|
| 37 | A | 860° C. × 40 sec | 695 | 26.3 | 46.6 | 56.4 | 37.8 | 1.71 | 0.01 |
| 38 | B | 720° C. × 40 hr | 713 | 31.9 | 54.6 | 58.4 | 35.1 | 1.68 | 0.01 |
| 39 | C | 850° C. × 10 sec | 683 | 23.4 | 41.9 | 55.8 | 45.2 | 1.82 | 0.01 |
| 40 | D | 660° C. × 30 sec* | 691 | 47.1 | 52.4 | 89.8 | 18.6 | — | — |
| 41 | E | 830° C. × 40 sec | 698 | 29.8 | 47.1 | 63.2 | 33.8 | 1.65 | 0.05 |
| 42 | F | 680° C. × 60 sec* | 685 | 42.0 | 49.5 | 84.8 | 22.6 | 1.12 | 0.45 |

TABLE 5-continued (Cold rolled steel sheets)

| | | | | | | | | | |
|---|---|---|---|---|---|---|---|---|---|
| 43 | G | 760° C. × 24 hr | 719 | 32.1 | 50.3 | 63.8 | 31.6 | 1.62 | 0.10 |
| 44 | H | 820° C. × 40 sec | 726 | 33.7 | 54.3 | 62.0 | 29.1 | 1.52 | 0.08 |
| 45 | I | 650° C. × 40 hr* | 689 | 43.3 | 49.8 | 86.9 | 21.9 | 1.05 | 0.55 |
| 46 | J | 880° C. × 20 sec | 716 | 30.2 | 47.7 | 63.3 | 33.3 | 1.61 | 0.15 |
| 47 | K | 650° C. × 60 sec* | 696 | 45.0 | 50.1 | 89.8 | 19.7 | 1.02 | 0.65 |
| 48 | L | 730° C. × 24 hr | 680 | 26.8 | 42.6 | 62.9 | 37.7 | 1.83 | 0.09 |
| 49 | M | 660° C. × 40 hr* | 674 | 40.5 | 46.1 | 87.8 | 27.1 | 1.16 | 0.40 |
| 50 | N | 850° C. × 20 sec | 688 | 27.7 | 44.1 | 62.8 | 36.3 | 1.78 | 0.11 |
| 51 | O | 800° C. × 60 sec | 691 | 28.1 | 44.9 | 62.5 | 35.0 | 1.60 | 0.08 |
| 52 | P | 800° C. × 60 sec | 670 | 25.3 | 45.1 | 56.0 | 36.1 | 1.65 | 0.10 |
| 53 | Q | 800° C. × 60 sec | 681 | 25.9 | 45.3 | 57.1 | 36.9 | 1.75 | 0.05 |
| 54 | R | 800° C. × 60 sec | 692 | 28.5 | 47.6 | 59.8 | 35.0 | 1.55 | 0.12 |
| 55 | S | 740° C. × 24 hr | 738 | 37.9 | 60.2 | 62.9 | 26.3 | 1.50 | 0.15 |

| Sample No. | Al (kgf/mm$^2$) | Property after heat treatment Grain size number | Plating | Remarks |
|---|---|---|---|---|
| 37 | 0.0 | 7.9 | none | Suitable example |
| 38 | 0.0 | 8.0 | electro-plating | Suitable example |
| 39 | 0.0 | 7.4 | zinc hot dipping | Suitable example |
| 40 | 0.1 | 7.1 | none | Comparative example |
| 41 | 0.1 | 7.6 | aluminum hot dipping | Suitable example |
| 42 | 0.0 | 7.2 | none | Comparative example |
| 43 | 0.0 | 7.3 | none | Suitable example |
| 44 | 0.0 | 8.0 | zinc hot dipping | Suitable example |
| 45 | 0.2 | 6.7 | electro-plating | Comparative example |
| 46 | 0.1 | 7.8 | none | Suitable example |
| 47 | 0.1 | 7.4 | zinc hot dipping | Comparative example |
| 48 | 0.1 | 7.7 | none | Suitable example |
| 49 | 0.3 | 6.6 | none | Comparative example |
| 50 | 0.0 | 7.4 | zinc hot dipping | Suitable example |
| 51 | 0.2 | 7.8 | none | Suitable example |
| 52 | 0.0 | 7.6 | none | Suitable example |
| 53 | 0.0 | 8.0 | none | Suitable example |
| 54 | 0.5 | 8.3 | none | Suitable example |
| 55 | 0.5 | 8.3 | electro-plating | Suitable example |

*indicates one existing without the limited range of this invention

TABLE 6

(Cold rolled steel sheets)

| Sample No. | Steel symbol | Annealing condition | Recrystallization temperature (°C.) | Mechanical properties YS (kgf/mm²) | TS (kgf/mm²) | YR (%) | El (%) | r-value | Δr |
|---|---|---|---|---|---|---|---|---|---|
| 56 | T | 860° C. × 30 ssec | 700 | 30.2 | 50.1 | 60.2 | 35.7 | 1.58 | 0.09 |
| 57 | U | 720° C. × 30 hr | 679 | 29.2 | 47.0 | 62.1 | 36.7 | 1.68 | 0.06 |
| 58 | V | 850° C. × 40 sec | 716 | 32.6 | 51.8 | 62.9 | 35.3 | 1.63 | 0.10 |
| 59 | W | 820° C. × 60 sec | 693 | 29.8 | 47.9 | 62.2 | 35.9 | 1.67 | 0.05 |
| 60 | X | 730° C. × 20 hr | 726 | 33.3 | 55.7 | 59.7 | 34.7 | 1.54 | 0.11 |
| 61 | Y | 760° C. × 40 hr | 746 | 38.3 | 62.9 | 60.8 | 25.6 | 1.50 | 0.15 |
| 62 | Z | 810° C. × 20 sec | 673 | 25.1 | 45.1 | 55.6 | 36.0 | 1.69 | 0.08 |
| 63 | a | 820° C. × 40 sec | 660 | 26.2 | 39.2 | 66.8 | 40.8 | 1.96 | 0.08 |
| 64 | b | 760° C. × 40 hr | 749 | 46.4 | 61.8 | 75.0 | 21.5 | 0.98 | 0.65 |
| 65 | c | 850° C. × 30 sec | 714 | 40.8 | 48.1 | 84.8 | 29.8 | 1.22 | 0.40 |
| 66 | d | 810° C. × 20 sec | 699 | 38.1 | 49.6 | 76.8 | 28.2 | 1.20 | 0.45 |
| 67 | e | 840° C. × 30 sec | 702 | 36.1 | 45.8 | 78.8 | 30.5 | 1.36 | 0.35 |
| 68 | D | 750° C. × 24 hr | 691 | 29.5 | 48.3 | 61.0 | 35.7 | 1.61 | 0.07 |
| 69 | F | 820° C. × 30 sec | 685 | 25.5 | 43.2 | 59.0 | 37.2 | 1.80 | 0.11 |
| 70 | I | 720° C. × 40 hr | 689 | 26.0 | 45.9 | 56.6 | 36.4 | 1.66 | 0.09 |
| 71 | K | 860° C. × 20 sec | 696 | 30.7 | 49.1 | 62.5 | 35.4 | 1.58 | 0.10 |
| 72 | M | 840° C. × 30 sec | 674 | 24.2 | 42.4 | 57.0 | 43.9 | 1.86 | 0.07 |

| Sample No. | Al (kgf/mm²) | Property after heat treatment Grain size number | Plating | Remarks |
|---|---|---|---|---|
| 56 | 0.0 | 7.8 | none | Suitable example |
| 57 | 0.1 | 7.5 | " | Suitable example |
| 58 | 0.0 | 7.8 | zinc hot dipping | Suitable example |
| 59 | 0.2 | 7.7 | none | Suitable example |
| 60 | 0.1 | 8.0 | none | Suitable example |
| 61 | 0.2 | 8.2 | none | Suitable example |
| 62 | 0.0 | 7.4 | none | Suitable example |
| 63 | 5.9 | 6.3 | none | Comparative example |
| 64 | 0.3 | 7.5 | none | Comparative example |
| 65 | 4.4 | 6.5 | zinc hot dipping | Comparative example |
| 66 | 0.0 | 8.1 | none | Comparative example |
| 67 | 0.1 | 7.1 | none | Comparative example |
| 68 | 0.0 | 7.4 | none | Suitable example |
| 69 | 0.2 | 7.6 | electroplating | Suitable example |
| 70 | 0.0 | 7.2 | none | Suitable example |
| 71 | 0.1 | 7.7 | zinc hot dipping | Suitable example |
| 72 | 0.1 | 7.7 | none | Suitable example |

Here, each of the treatment conditions is as follows.

In the electroplating, Zn-Ni plating was carried out with a plating amount of 30 g/m².

In the hot dipping, Zn plating or Al plating was carried out wherein the Zn plating was carried out with a bath temperature: 475° C., a dipping sheet temperature: 475° C., a dipping period: 3 seconds, an alloy formation temperature: 485° C., and a plating amount of 45 g/m$^2$, and the Al plating was carried out with a bath temperature: 650° C., a dipping sheet temperature: 650° C., a dipping period: 3 seconds, and a plating amount of 30 g/m$^2$.

The heat treatment (reheating) condition was such that heating was performed to 950° C. to maintain for 30 minutes, followed by mild cooling at 5° C./second.

In addition, as a test condition, in the tensile test was used a test piece of JIS No. 5, and YS, TS, and El were investigated in the rolling direction.

The r-value was determined by measuring widths at three points of the central portion of a test piece in the length direction at a distortion of 15% and of positions of 12.5 mm at both sides with respect to the center, and the average r-value and Δr were determined according to the following equations, respectively.

$$\text{Average r-value}=(r_0+R_{90}2r_{45})/4$$

$$\Delta r=(r_0+r_{90}-2r_{45})/4$$

Incidentally, $r_0$, $r_{45}$, and $r_{90}$ are each r-value in the rolling direction ($r_0$), a direction ($r_{45}$) at an angle of 45° to the rolling direction, and a direction ($r_{90}$) at an angle of 90° to the rolling direction, respectively.

AI value was determined from difference in deformation stress before and after aging by applying preliminary tensile distortion of 7.5% followed by aging treatment at 100° C. for 30 minutes.

It will be clear from Tables 3, 4, and 5, 6, that the suitable examples of the present invention exhibit excellent various properties such that in any one of the cases of the presence or absence of plating and of the box annealing or the continuous annealing as the annealing method, a tensile strength not less than 40 kgf/mm$^2$ can be obtained, and properties being difficult to cause softening by reheating are presented with a low yield ratio (not more than 70%) and a high El and a crystallization grain size after heat treatment of not less than 7, and further each of the cold rolled sheets has a high average r-value and a low Δr-value which is an index of the in-plane anisotropy, and a complete non-aging property is ensured at not more than 1 kgf/mm$^2$ for the aging index AI and the like.

According to the present invention, even in the case of the low carbon steel sheet in which the C content is higher than that of the extra low carbon steel, by completely fixing the solid solution C, S, N and the like, a high strength steel sheet having a small in-plane anisotropy, a low yield ratio, and complete non-aging in which the softening is difficult to take place by heating at a high temperature can be obtained. In the case of the cold rolled sheet, a high strength precipitation strengthened steel having a higher r-value can be obtained. Therefore, the present invention is useful for enlarging use of the precipitation strengthened steel sheet owing to its usefulness.

We claim:

1. A high strength cold rolled steel sheet having a non-aging property, a low yield ratio of less than 65%, deep drawability and secondary forming brittleness suitable for press forming and for use as interior or exterior sheets for automobiles, said steel consisting essentially of:

C: from more than 0.01 wt % to less than 0.1 wt %,

Si: from 0.1 wt % to 1.2 wt %,

Mn: not more than 3.0 wt %,

Ti: a ratio of effective *Ti(wt %) represented by the following equation to said C(wt %), that is the effective *Ti(wt %)/C(wt %) is from 4 to 12:

effective *Ti(wt %)=Ti(wt %)-1.5S(wt %)-3.43N(wt %),

B: from 0.0005 wt % to 0.005 wt %,

Al: not more than 0.1 wt %,

P: not more than 0.1 wt %, provided that a ratio of P/C is less than 1.5,

S: not more than 0.02 wt %, and

N: not more than 0.005 wt %, and the remainder being iron and inevitable impurities.

2. The high strength steel sheet claimed in claim 1, further selected from V: from 0.02 wt % to 0.2 wt %, Nb: from 0.02 wt % to 0.2 wt %, and Zr: from 0.02 wt % to 0.2 wt %, by replacing a part of the iron of the remainder.

3. The high strength steel sheet claimed in claim 1, further comprising at least one element selected from Cr: from 0.05 wt % to 1.5 wt %, Ni: from 0.05 wt % to 2.0 wt %, Mo: from 0.05 wt % to 1.0 wt %, Cu: from 0.05 wt % to 1.5 wt %, by replacing a part of the iron of the remainder.

4. The high strength steel sheet claimed in claim 1, further comprising at least one element selected from V: from 0.02 wt % to 0.2 wt %, Nb: from 0.02 wt % to 0.2 wt %, Zr: from 0.02 wt % to 0.2 wt %, Cr: from 0.05 wt % to 1.5 wt %, Ni: from 0.05 wt % to 2.0 wt %, Mo: from 0.05 wt % to 1.0 wt %, Cu: from 0.05 wt % to 1.5 wt %, by replacing a part of the iron of the remainder.

5. A high strength cold rolled steel sheet having a non-aging property, a low yield ratio less than 65%, deep drawability and secondary forming brittleness adapted for press forming and for use as interior or exterior sheets for automobiles, said steel consisting essentially of:

C: from 0.01 wt % to less than 0.1 wt %,

Si: from 0.1 wt % to 1.2 wt %,

Mn: not more than 3.0 wt %,

Ti: a ratio of effective *Ti(wt %) represented by the following equation to said C(wt %), that is the effective *Ti(wt %)/C(wt %) is from 4 to 12:

effective *Ti(wt%)=Ti(wt %)-1.5S(wt %)-3.43N(wt %)

B: from 0.0005 wt % to 0.005 wt %,

Ca: from 0.0005 wt % to 0.005 wt %,

Al: not more than 0.1 wt %,

P: not more than 0.1 wt %, provided that a ratio of P/C is less than 1.5.

S: not more than 0.02 wt %,

N: not more than 0.005 wt %, and the remainder being iron and inevitable impurities.

6. The high strength steel sheet claimed in claim 5, further containing one or more kinds of ones selected from V: from 0.02 wt % to 0.2 wt %, Nb: from 0.02 wt % to 0.2 wt %, Zr: from 0.02 wt % to 0.2 wt %, by placing a part of the iron of the remainder.

7. The high strength steel sheet claimed in claim 5, further containing one or more kinds of ones selected from Cr: from 0.05 wt % to 1.5 wt %, Ni: from 0.05 wt % to 2.0 wt %, Mo: from 0.05 wt % to 1.0 wt %, and Cu: from 0.05 wt % to 1.5 wt %, by replacing a part of the iron of the remainder.

8. The high strength steel sheet claimed in claim 5, further containing one or more kinds of ones selected from V: from 0.02 wt % to 0.2 wt %, Nb: from 0.02 wt % to 0.2 wt %, Zr: from 0.02 wt % to 0.2 wt %, Cr: from 0.05 wt % to 1.5 wt %, Ni: from 0.05 wt % to 2.0 wt %, Mo: from 0.05 wt % to 1.0 wt %, and Cu: from 0.05 wt % to 1.5 wt %, by replacing a part of the iron of the remainder.

9. A method for producing a high strength steel sheet having a non-aging property, a low yield ratio property, deep drawability, and secondary forming brittleness adapted for press forming, said method comprising the steps of:

preparing a steel slab consisted essentially of:

C: from 0.01 wt % to less than 0.1 wt %,

Si: from 0.1 wt % to 1.2 wt %,

Mn: not more than 3.0 wt %,

Ti: a ratio of effective *Ti(wt %) represented by the following equation to said C(wt %), that is the effective *Ti(wt %)/C(wt %) is from 4 to 12:

effective *T(wt %)=Ti(wt %)-1.5S(wt %)-3.43N(wt %),

B: from 0.0005 wt % to 0.005 wt %,

Al: not more than 0.1 wt %,

P: not more than 0.1 wt %, provided that a ratio of P/C is less than 1.5,

S: not more than 0.02 wt %, and

N: not more than 0.005 wt %, heating the steel slab in a temperature range of 1100° C.–1280° C. and hot rolling the steel slab to provide a hot rolled sheet.

10. The method as claimed in claim 9, wherein the hot rolling is followed by application of electroplating or hot dipping.

11. The method claimed in claim 9, further comprising steps of cold rolling the hot rolled sheet to provide a cold rolled sheet, and subsequently annealing the cold rolled sheet at a temperature not lower than a recrystallization temperature.

12. The method as claimed in claim 11, wherein the annealing is followed by application of electroplating or hot dipping.

13. The high strength cold rolled steel sheet of claim 1 having a thickness not greater than 0.8 mm.

14. The high strength cold rolled steel sheet of claim 5 having a thickness of at most 0.8 mm.

15. The method for producing a high strength steel sheet of claim 9 having a thickness of at most 3.2 mm.

* * * * *